US006142207A

United States Patent [19]

Richardot

[11] Patent Number: 6,142,207

[45] Date of Patent: Nov. 7, 2000

[54] HOT MELT GLUE APPLICATOR AND GLUE STICK FOR USE THEREIN

[75] Inventor: Francis Richardot, Le Val d'Ajol, France

[73] Assignee: Sofragraf Industries, Saint-Ame, France

[21] Appl. No.: 09/027,188

[22] Filed: Feb. 20, 1998

[30] Foreign Application Priority Data

Feb. 21, 1997 [FR] France ..... 97 02104

[51] Int. Cl.[7] ..... B65C 11/04; H05B 1/00; H05B 3/06; B67D 5/62

[52] U.S. Cl. ..... 156/578; 156/579; 219/229; 219/542; 222/146.5

[58] Field of Search ..... 156/578, 579; 219/542, 543, 227, 228, 229; 222/146.5; 338/292

[56] References Cited

U.S. PATENT DOCUMENTS

| | | | |
|---|---|---|---|
| 4,145,601 | 3/1979 | Lavrentiev et al. | 219/543 X |
| 5,362,164 | 11/1994 | Wingert | 401/2 |
| 5,462,206 | 10/1995 | Kwasie | 222/146.5 |
| 5,557,704 | 9/1996 | Dennis et al. | 219/543 X |
| 5,965,049 | 10/1999 | Carlet | 219/543 X |

FOREIGN PATENT DOCUMENTS

| | | |
|---|---|---|
| 0 385 235 | 9/1990 | European Pat. Off. . |
| 2565131A | 12/1985 | France . |
| 0423388A | 4/1991 | Germany . |

*Primary Examiner*—Richard Crispino
*Assistant Examiner*—Sue A. Purvis
*Attorney, Agent, or Firm*—Stevens, Davis, Miller & Mosher, L.L.P.

[57] ABSTRACT

A hot melt glue applicator has an elongate chamber having a first end shaped as a hot melt glue stick entry and a second end equipped with a molten glue dispensing nozzle. The applicator includes a device for progressively moving the glue stick into the chamber, and a device for electrically heating that part of the glue stick which is in the chamber. The device for electrically heating includes at least one heating element including an electrically resistive material track which can be connected to an electrical power supply and which is formed on an electrically insulative surface of a substrate, so as to be in intimate thermal contact with a mass of glue contained in the chamber. Because of the intimate thermal contact established between the resistive track of the heating element and the mass of glue, the thermal energy emitted by the track because of the Joule effect is virtually all absorbed by the mass of glue, which considerably improves the thermal efficiency of the applicator.

16 Claims, 2 Drawing Sheets

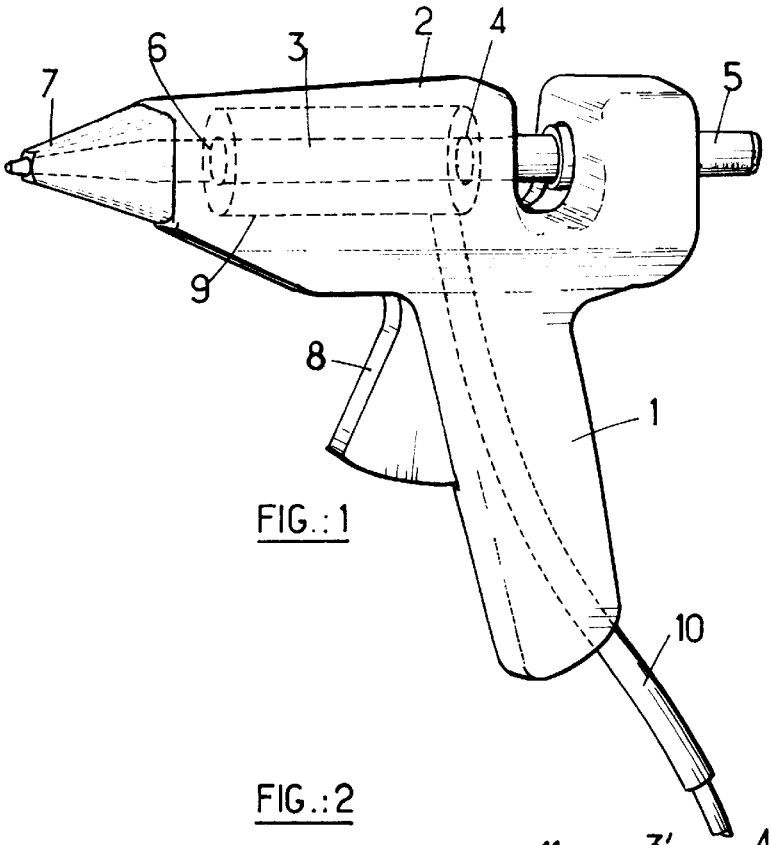
FIG.: 1
FIG.: 3
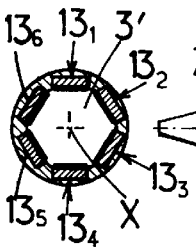
FIG.: 2
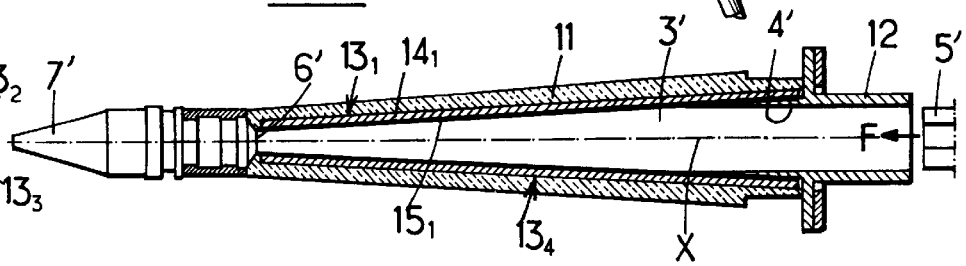
FIG.: 4
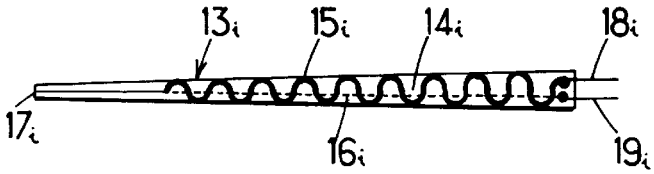
FIG.: 5
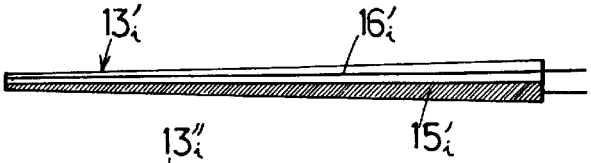
FIG.: 6
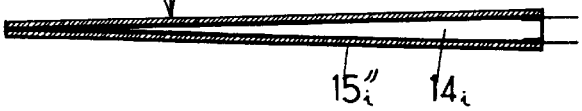

HOT MELT GLUE APPLICATOR AND GLUE STICK FOR USE THEREIN

BACKGROUND OF THE INVENTION

1. Field of the invention

The present invention relates to a hot melt glue applicator and a glue stick for use therein.

2. Description of the Related Art

FIG. 1 of the appended drawings shows a hot melt glue applicator of a type that is widely used at present. It is in the form of a gun with a handgrip 1 projecting from a body 2. The body 2 includes an elongate chamber 3 having a first end 4 shaped as an inlet for a hot melt glue stick 5 and a second end 6 equipped with a nozzle 7 for dispensing molten glue. The applicator also includes mechanical means (not shown) actuated by pressure on a trigger 8 to push the glue stick 5 progressively into the chamber 3 and electrical heating means disposed around the chamber 3 to melt the material of the glue stick 5 contained in that chamber. The aforementioned means are disposed in a volume 9 around the chamber 3 and are supplied with power by an external electrical power supply (for example the mains electrical supply) via an electrical cable 10 passing through the handgrip.

The drops of molten glue that emerge from the nozzle 7 can be used to assemble parts to each other or to supports, for example to fix moldings or claddings to walls, ceilings, etc.

The heating means incorporated in applicators of the above kind are essentially of two types at present. In the first, they comprise a cylindrical cartridge filled with a material constituting an electrical resistance and having a positive temperature coefficient. The cartridge is supplied with electrical power and is mounted in a metal sheath through which the chamber 3 passes and heats the sheath by thermal conduction. Because of the positive temperature coefficient of the material contained in the cartridge the resistance of the material increases with its temperature, which regulates the electrical heating current.

The use of a cartridge of the above kind is advantageous because of its low cost, its compact overall size and the regulation function that it assures. On the other hand, applicators equipped with this cartridge have long warm-up times (around ten minutes) and limited heating power. Furthermore, as the cartridges are supplied by specialist manufacturers the designer of the applicator is restricted in choice by the nominal performance of the cartridge selected by the manufacturer, in particular the maximal heating temperature.

Another type of heating means currently employed in the aforementioned applicators takes the form of an insulated electrical resistance in the form of a filament wound around the chamber 3 on a metal sheath through which the chamber passes. With this technology warm-up times are shorter (around five minutes), the power of the device can be varied by appropriately calibrating the resistance employed and the maximal heating temperature can be controlled by a thermostat (for example a bimetallic strip).

On the other hand, the resistance must be associated with thermal and electrical insulation means that increase the price of the applicator. When the resistance incorporates a glass filament, the latter eventually becomes fragile due to the variations in thermal flux to which it is subjected. It is more difficult to obtain accurate regulation of the heating current than with the aforementioned cartridges and the assembly and the adjustment of the applicator are relatively labor intensive, which increases the price of the applicator.

In both types of heating means described hereinabove the whole of a sheath is heated, not just the glue to be melted. A significant portion of the electrical energy consumed by the heating means is therefore dissipated elsewhere than in the glue.

Accordingly, an aim of the present invention is to provide a glue applicator that does not have the above-mentioned drawbacks of the prior art applicators and which in particular has a very short warm-up time, a high heat efficiency and a high molten glue flowrate.

Another aim of the present invention is to provide an applicator of the above kind that is reliable, that is electrically safe for the user and that has a low unit cost of manufacture.

SUMMARY OF THE INVENTION

The above aims of the invention, and others that will become apparent on reading the description given below, are achieved with a hot melt glue applicator comprising an elongate chamber having a first end shaped as a hot melt glue stick entry and a second end equipped with a molten glue dispensing nozzle, means for progressively pushing the stick into the chamber and means for electrically heating the part of the stick contained in the chamber including at least one heating element consisting of an electrically resistive material track provided with means for connecting it to an electrical power supply and formed on an electrically insulative surface of a substrate adapted to be in intimate thermal contact with a mass of glue contained in the chamber.

Because of the intimate thermal contact established in this way between the resistive track of the heating element and the mass of glue, the thermal energy emitted by the track because of the Joule effect is virtually all absorbed by the mass of glue, which considerably improves the thermal efficiency of the heating means of the applicator in accordance with the invention compared with that of the prior art means described hereinabove.

In one preferred embodiment of the invention the substrate of a heating element is planar. The heating element is then disposed in a lateral wall of the chamber. Alternatively, it can be disposed in a central position in the chamber.

In another embodiment the applicator comprises a plurality of such elements lining the wall of the chamber with the faces of their substrates that carry the resistive tracks facing towards the axis of the chamber. The chamber advantageously has a conical apex at the same end as the glue dispenser nozzle. The substrates of the heating elements are then each in the form of an elongate triangle matching the conical shape of the chamber.

Other features and advantages of the present invention will become apparent from a reading of the following description and an examination of the appended drawings.

BRIEF DESCRIPTION OF THE DRAWINGS

FIG. 1 is a perspective view of a prior art glue applicator described in the preamble to the present description.

FIGS. 2 and 3 are respectively views in axial section and in crosssection of a glue heating body incorporated into an applicator in accordance with the invention.

FIGS. 4 through 6 are schematic representations of three embodiments of a heating element incorporated into the heating body of FIGS. 2 and 3.

DETAILED DESCRIPTION OF THE PREFERRED EMBODIMENTS

Figure 7:
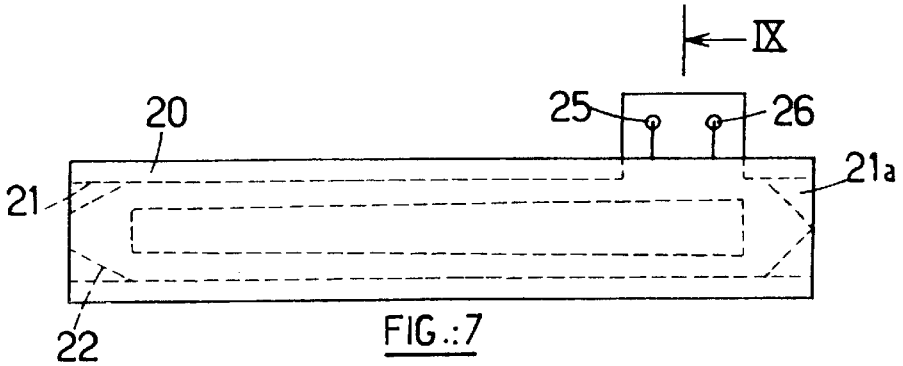
FIG. 7 is a schematic representation of another embodiment of the heating body of the glue applicator of the invention.

The heating body shown in FIGS. 2 and 3 of the appended drawings is designed to be installed in place of a conventional heating body in the volume 9 indicated in FIG. 1. The body comprises a bush 11 preferably made from an electrically and thermally insulative material. It advantageously, but not necessarily, has a conical shape about an axis X with a ring 12 mounted at the entry 4' of the bush to guide a glue stick 5' pushed in the direction of the arrow F into an elongate chamber 3' inside the bush 11 and concentric with the axis X. The other end 6' of the bush has a nozzle 7' for dispensing the glue from the stick after the latter has been melted in the heating body. It is clear that the components or members 3', 4', 6' and 7' are identical or equivalent to the respective items 3, 4, 6 and 7 of the prior art applicator shown in FIG. 1.

In accordance with the present invention, the wall of the chamber 3' is lined with at least one, and preferably a plurality of, heating elements $\mathbf{13}_1$, $\mathbf{13}_2$, . . . , $\mathbf{13}_6$ symmetrically distributed around the axis X so as to cover substantially all of the surface of this wall. To this end, the bush 11 advantageously has axial recesses in the wall of the chamber, each the same shape as and receiving one heating element $\mathbf{13}_i$ (i =1 through 6), as is apparent in the FIG. 3 sectional view. Each heating element is wedged and/or glued into its recess.

In accordance with one feature of the present invention, each heating element $\mathbf{13}_i$ (see FIG. 4) comprises a plane substrate $\mathbf{14}_i$ in the form of an elongate triangle matching the conical shape of the chamber 3'. The frustoconical shape of this chamber, with the apex at the same end as the nozzle 7', enables the mass of molten glue in the chamber 3' in use to taper progressively towards the nozzle 7' to match the small diameter of a passage through that nozzle.

The elongate triangular shape substrate $\mathbf{14}_i$ which constitutes the base of a heating element $\mathbf{13}_i$ has an insulative surface that carries an electrically resistive material track $\mathbf{15}_i$ in turn covered with a layer of electrical insulation (not shown). The electrical resistance of this material is such that the passage of an appropriate electrical current through all the tracks $\mathbf{15}_i$ of the heating body rapidly softens and then melts the glue of a stick 5' inserted into the chamber 3'. To this end the tracks $\mathbf{15}_i$ face towards the axis X of the chamber 3' (see FIG. 3). They are therefore and advantageously in intimate contact with the mass of glue in the chamber 3' via the thin layer of electrical insulation that separates each track from the glue.

A heating element like that shown in FIG. 4 can be made using the means employed to fabricate thick film hybrid circuits. A circuit of this kind conventionally comprises an alumina, enameled sheet metal or stainless sheet metal substrate covered with a dielectric, for example, onto which is screen printed an array of conductive tracks and resistances, the circuit being completed by active and/or passive components attached to the substrate.

Multilayer circuits are produced either by stacking screen printed and fired alumina substrates or by covering a basic substrate with an insulative paste which is then screen printed.

Accordingly the heating element from FIG. 4 can be made by depositing a conductive track $\mathbf{16}_i$ onto a first substrate and covering the track with an insulative paste onto which the resistive track $\mathbf{15}_i$ is screen printed. The latter is finally covered with an electrical insulation layer, as stated above.

The tracks $\mathbf{15}_i$ and $\mathbf{16}_i$ are connected by a via at the end $\mathbf{17}_i$ of the element. Contacts $\mathbf{18}_i$, $\mathbf{19}_i$ are welded to the ends of the tracks $\mathbf{15}_i$, $\mathbf{16}_i$, respectively, for connecting these tracks to an electrical power supply.

A two-layer circuit of the above kind could also be made by the "co-fired" multilayer circuit technique, avoiding the multiple firing steps necessary in the fabrication procedure described above.

The resistive track $\mathbf{15}_i$ of the heating element from FIG. 4 is serpentine to increase its surface area and therefore its electrical resistance. In the heating element $\mathbf{13'}_i$ shown in FIG. 5 the resistive track $\mathbf{15'}_i$ is straight, like the adjacent return conductive track $\mathbf{16'}_i$ formed in the same layer as the track $\mathbf{15'}_i$.

The circuit of the heating element $\mathbf{13''}_i$ shown in FIG. 6 is also a single-layer circuit, the resistive track $\mathbf{15''}_i$ running over two opposed longitudinal edges of one face of the substrate $\mathbf{14}_i$.

Of course, track geometries other than those shown in FIGS. 3 through 6 are possible, the latter being given by way of example only.

As indicated above, the tracks are screen printed using a procedure well known in the fabrication of thick film hybrid circuits carrying electrical resistances. The track is then constituted of a resistive "ink" deposited as a paste onto the substrate through a mask and then dried to eliminate the solvents incorporated in the paste when deposited. These steps are followed by firing at high temperature (around 850° C.) to stabilize the heating element. Various paste compositions well known to the skilled person can be used in the present invention. To give one illustrative and non-limiting example, pastes based on metals and ruthenium or indium oxide can be used, having a resistance in the range 1Ω/ to 1000Ω/ for a track thickness in the range 8 $\mu$m to 20 $\mu$m.

An ink having a positive temperature coefficient is advantageously chosen in order to regulate the supply current of the heating elements. The skilled person has available a wide range of inks with temperature coefficients up to $3500.10^{-6}$/° C.

DuPont de Nemours inks 5091, 5092 and 5093 have been successfully used to produce the heating elements of the applicator of the invention.

The nature and the positions of the heating elements of the heating body of the glue applicator of the invention are favorable to a fast warm-up time and high thermal efficiency of the applicator, for the following reasons. The position of each heating element, in intimate contact with the surface of the volume of glue, assures direct transfer of heat between the heating element and the glue. This is not the case in the glue applicators referred to in the preamble of the present description in which the heating elements heat a metal sheath which transfers heat to the glue. The efficiency of this double heat transfer is lower than that of the direct heat transfer used in an applicator of the invention. Moreover, the efficiency of the latter applicator is further improved by the fact that the heat radiated by the heating elements is focused in the mass of glue. An appropriate choice of the materials constituting the substrates $\mathbf{14}_i$ of the tracks and the bush 11 minimizes losses by thermal conduction in these materials.

Because of the improved thermal efficiency obtained in this way, it is feasible to supply an applicator in accordance with the invention from a battery rather than from the electrical mains supply, as is generally the case at present. This improvement in the autonomy of the user of the applicator in accordance with the invention is a significant advantage of the invention.

The use of technologies proven in the fabrication of thick film hybrid circuits to manufacture the heating elements of the applicator in accordance with the invention makes it reliable and safe to use whilst reducing its unit manufacturing cost by virtue of the high level of automated mass production that is a feature of these technologies. A large number of heating elements can be fabricated on one and the same rectangular substrate plate, arranged side by side and head-to-tail on the plate so as to maximize the usable area of the substrate. All the resistive tracks are deposited simultaneously and then dried simultaneously. The heating elements are finally separated by sawing up the substrate or by any other cutting means.

The cross-section of the chamber 3' is polygonal (see FIGS. 2 and 3) because of the presence of the heating elements $\mathbf{13}_i$, and the cross-section of the glue stick 5' in accordance with the invention is itself advantageously this shape (see FIG. 2) to facilitate its insertion into the chamber and so that the outside surface of the stick is close to that of the heating elements.

Of course, the invention is not limited to the embodiments shown which have been described by way of example only. For example, the wall of the chamber 3' could be cylindrical rather than conical and its cross-section could have a polygonal shape other than a hexagonal shape, or even a circular shape. One or more helical resistive tracks could then be formed on the wall of the chamber 3' to constitute the heating elements.

Figure 8:
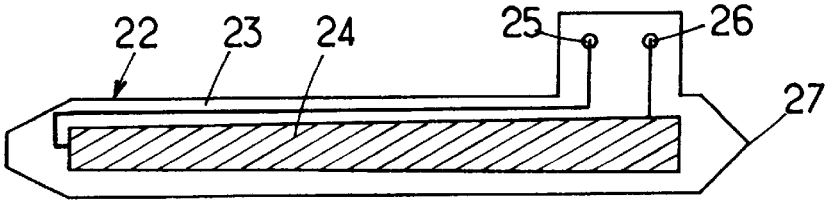
FIG. 8 is a schematic representation of the heating element incorporated into the heating body from FIG. 7.
Figure 9:
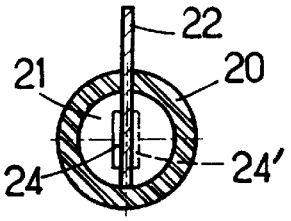
FIG. 9 is a view of the heating body from FIG. 7 in section taken along the line IX.

Another embodiment of the heating body of a glue applicator in accordance with the present invention, shown in FIGS. 7 through 9, comprises a bush 20 through which extends a cylindrical chamber 21 adapted to receive a solid glue stick of the same shape. The chamber 21 accommodates a heating element 22 extending along the longitudinal axis of the chamber 21 in a substantially diametral plane of the latter (see FIG. 9).

The heating element 22 has a plane substrate 23 with a structure analogous to the substrates $\mathbf{14}_i$ of the heating elements $\mathbf{13}_i$ described hereinabove. At least one face of the substrate is covered with an electrically resistive material track 24 covered with a layer of electrical insulation (not shown). Terminals 25, 26 connect this track to an external electrical power supply.

The glue stick is inserted into the heating body from the end 21*a* of the chamber 21. This end 27 of the substrate 23 of the heating element 22 is pointed to facilitate insertion of the stick into the chamber 21, the stick becoming impaled on the heating element. This is facilitated by the fact that the heat generated by the heating element softens the glue stick as it enters the chamber 21.

The central position of the heating element 22 in the chamber 21 assures complete absorption of the heat by the mass of the glue stick, which is beneficial from the point of view of the thermal efficiency of the heating body. A substrate 23 having a good thermal conductivity is preferably chosen, such as a metal substrate with appropriate electrical insulation, so that the heat generated by the track 24 is diffused from both sides of the substrate. This assures homogeneous heating of the mass of glue.

Alternatively, for perfectly homogeneous heating of the glue stick, another conductive track 24' can be placed on the other face of the substrate 22.

Figure 10:
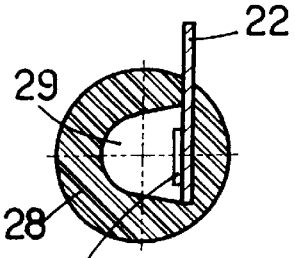
FIG. 10 is a sectional view similar to that of FIG. 9 of a variant of the heating body from FIGS. 7 through 9.

Alternatively, the heating element 22 can be disposed as shown in FIG. 10 to constitute a part of the wall of a chamber 29 formed in a heating body 28, the single track 24 being oriented towards the interior of this chamber, which accommodates the glue stick.

Figure 11:
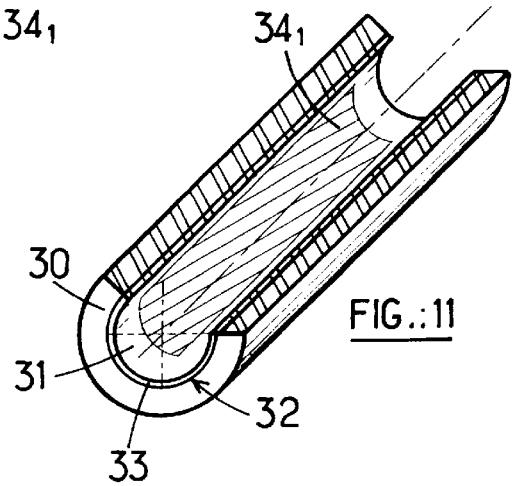

Nor is the invention limited to plane heating elements. The elements could be formed on circular conical or cylindrical substrates, for example, so as to match perfectly the shape of the chamber in the heating body that receives the glue stick. FIG. 11 shows a heating body consisting of a cylindrical jacket 30, which is partially cut away in the figure, made from a thermally insulative material, for example, with a cylindrical heating element 32 being . . . against the wall of an elongate chamber 31 passing through the jacket 30. The element 32 includes a cylindrical substrate 33 on the inside wall of which are formed one or more electrically insulative material tracks $\mathbf{34}_i$, etc.

Figure 12:
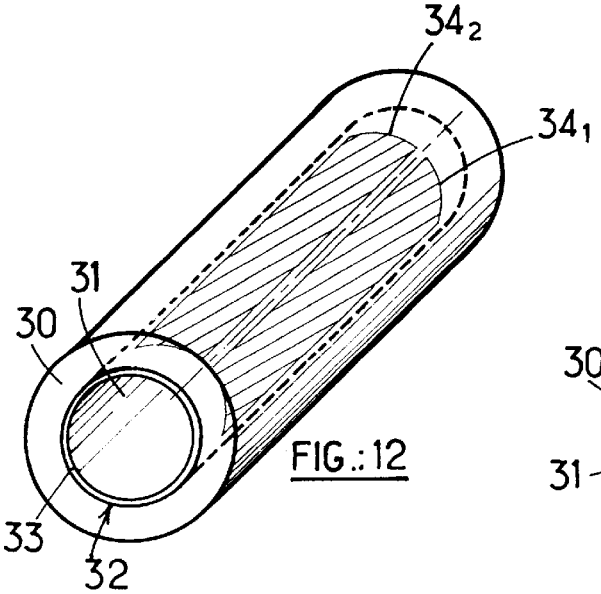
FIGS. 11 and 12 are schematic representations of two other variants of the heating body.

FIG. 12 shows a variant of the FIG. 11 embodiment which differs from the latter only in that the conductive tracks $\mathbf{34}_i$ are formed on the exterior wall of the substrate 33 to facilitate manufacture of the tracks. In this case the substrate 33 must be thin (a few tenths of a millimeter, for example) and made from a material that is a good conductor of heat to allow radiation of the heat emitted towards the interior of the chamber 31.

What is claimed is:

1. A hot melt glue applicator comprising (a) an elongate chamber having a first end shaped as a hot melt glue stick entry and a second end equipped with a molten glue dispensing nozzle;

(b) means for progressively pushing said glue stick into said chamber; and (c) means for electrically heating the part of said glue stick contained in said chamber, said means for electrically heating comprising at least one heating element comprising an electrically resistive material track provided with means for connecting said track to an electrical power supply, said track formed on an electrically insulative surface of a substrate so as to place said track in intimate thermal contact with a mass of glue contained in said chamber.

2. The applicator claimed in claim 1 wherein said substrate is planar.

3. The applicator claimed in claim 2 wherein said heating element having a planar substrate is disposed in a central position of said chamber, along the axis thereof.

4. The applicator claimed in claim 3 wherein said substrate of said heating element is pointed at said first end.

5. The applicator claimed in claim 3 wherein each face of said substrate carries an electrically resistive material track.

6. The applicator claimed in claim 2 wherein said heating element having a planar substrate is disposed in a lateral wall of said chamber.

7. An applicator as claimed in claim 2 including a plurality of heating elements lining the wall of said chamber with the faces of said heating elements substrates that carry said resistive tracks facing towards the axis of said chamber.

8. The applicator claimed in claim 7 wherein said chamber has a conical apex at said second end.

9. The applicator claimed in claim 8 wherein said substrates of said heating elements each has the shape of an elongate triangle matching the conical shape of said chamber.

10. The applicator claimed in claim 1 wherein said heating element has a non-plane substrate.

11. The applicator claimed in claim 10 wherein said substrate is cylindrical and pressed against the wall of said chamber.

12. The applicator claimed in claim 1 wherein said resistive track carried by each heating element is made by screen printing a deposit of a resistive paste onto said substrate using thick film hybrid circuit fabrication technology.

13. The applicator claimed in claim 12 wherein said track is made of a material having a positive temperature coefficient.

14. The applicator claimed in claim 12 wherein said paste contains metals, oxides of ruthenium and/or of indium.

15. The applicator claimed in claim 12 wherein said substrate is an alumina substrate or an enameled sheet metal substrate or a stainless sheet metal substrate covered with a dielectric layer.

16. The applicator claimed in claim 12 wherein said track has a resistance in the range of from 1Ω/ to 1000Ω/ and has a thickness in the range of from approximately 8 μm to approximately 20 μm.

* * * * *